United States Patent [19]

Grim

[11] 3,974,385

[45] Aug. 10, 1976

[54] X-RAY DIAGNOSTIC APPARATUS

[75] Inventor: Stig Grim, Osterskaar, Sweden

[73] Assignee: Siemens Aktiengesellschaft, Erlangen, Germany

[22] Filed: June 2, 1975

[21] Appl. No.: 583,092

Related U.S. Application Data

[63] Continuation-in-part of Ser. No. 421,485, Dec. 3, 1973, abandoned.

[30] Foreign Application Priority Data

Dec. 6, 1972 Sweden ..... 15891/72

[52] U.S. Cl. ..... 250/402; 250/409; 250/413

[51] Int. Cl.[2] ..... H05G 1/30

[58] Field of Search ..... 250/401, 402, 408, 409, 250/413, 414, 415, 416

[56] References Cited

UNITED STATES PATENTS

| | | | |
|---|---|---|---|
| 3,546,461 | 12/1970 | Craig | 250/416 |
| 3,766,391 | 10/1973 | Siedband | 250/403 |
| 3,783,286 | 1/1974 | Kremer | 250/409 |
| 3,842,280 | 10/1974 | Herrick | 250/409 |

*Primary Examiner*—Craig E. Church
*Attorney, Agent, or Firm*—Haseltine, Lake & Waters

[57] ABSTRACT

An X-ray diagnostic apparatus including an automatic exposure timer which measures the X-radiation dosage on a film during the exposure or X-raying of an object, and automatically interrupts the exposure when a predetermined dosage has been reached; including a programming arrangement in which the exposure data for example, the X-ray tube voltage, the initial emission current and the darkening of the film, are manually adjustable in an organ-programmed manner dependent upon the portion of a patient's body which is being X-rayed; and including a time control circuit by means of which the emission current is reduced during an exposure.

2 Claims, 8 Drawing Figures

X-RAY DIAGNOSTIC APPARATUS

FIELD OF THE INVENTION

This application is a continuation-in-part application of Ser. No. 421,485; filed Dec. 3, 1973 now abandoned.

The present invention relates to an X-ray diagnostic apparatus including an automatic exposure timer which measures the X-radiation dosage on a film during the exposure or X-raying of an object, and automatically interrupts the exposure when a predetermined dosage has been reached; including a programming arrangement in which the exposure data for example, the X-ray tube voltage, the initial emission current and the darkening of the film, are manually adjustable in an organ-programmed manner dependent upon the portion of a patient's body which is being X-rayed; and including a time control circuit by means of which the emission current is reduced during an exposure.

Radiological practice, as well as theoretical investigations, verify that the X-ray tube voltage should be varied in dependence upon the density or thickness of the object in order to achieve optimum X-ray pictures.

DISCUSSION OF THE PRIOR ART

In a known apparatus of the above-mentioned type which includes means for varying the X-ray tube voltage in dependence upon the density or thickness of the object, the current of an ionization chamber is utilized as the criterion for the object density and, dependent upon this current, the X-ray tube voltage is switched over during this exposure. This is effectuated in that pickups or taps are associated with a variable transformer, by means of which there is carried out the switching over of the voltage which is transmitted to the primary winding of a high-voltage transformer.

In another apparatus having an automatic organ selecting device, wherein the magnitude of the X-ray tube voltage is adjustable in dependence upon the density of the object, there are provided two correcting actuators or push-buttons. Upon actuation of these correcting push-buttons, the programmed X-ray tube voltage is either lowered or raised for, respectively, a thin or heavy object. In this apparatus the operation cannot be readily surveyed due to the inclusion of the additional push-buttons, and a subjective evaluation by the operating personnel becomes necessary, which should be avoided.

The known X-ray diagnostic apparatus which include an automatic exposure timer, wherein the emission current is reduced during the exposure ("falling load"), in which the X-ray tube voltage is maintained constant during the exposure, and in which there are provided means through the intermediary of which the X-ray tube voltage may be adjusted dependent upon the density of the object, are quite complex and consequently very expensive.

SUMMARY OF THE INVENTION

Accordingly, it is an object of the present invention to simplify the operation of an X-ray diagnostic apparatus of the above-mentioned type, and to concurrently obtain an improved automatic correlation of the X-ray tube voltage at varied object densities or thicknesses.

The foregoing object is inventively attained in that the programming arrangement has means associated therewith, through the intermediary of which the time control circuit of a predetermined body organ or corresponding to a type of examination may be influenced in a manner so that the timewise cycle of the emission current during exposure depends upon the organ being X-rayed.

The time dependence of the emission current, in an apparatus according to the invention, is determined through a time control circuit which sets the emission current as a function of time responsive to the actuation of the operating keys or push-buttons of an organ selector, or by means of a comparable arrangement. Thereby it becomes possible that for a thin normal or a heavy object, there may be obtained an increase in the X-ray tube voltage to one desired for one of the various body organs or types of examinations whereby the X-ray tube output is lowered concurrently with the exposure time so as to avoid an overloading of the tube anode.

BRIEF DESCRIPTION OF THE DRAWINGS

Reference may now be had to the detailed description of preferred embodiments of the invention, taken in conjunction with the accompanying drawings; in which.

DETAILED DESCRIPTION

Figure 1:
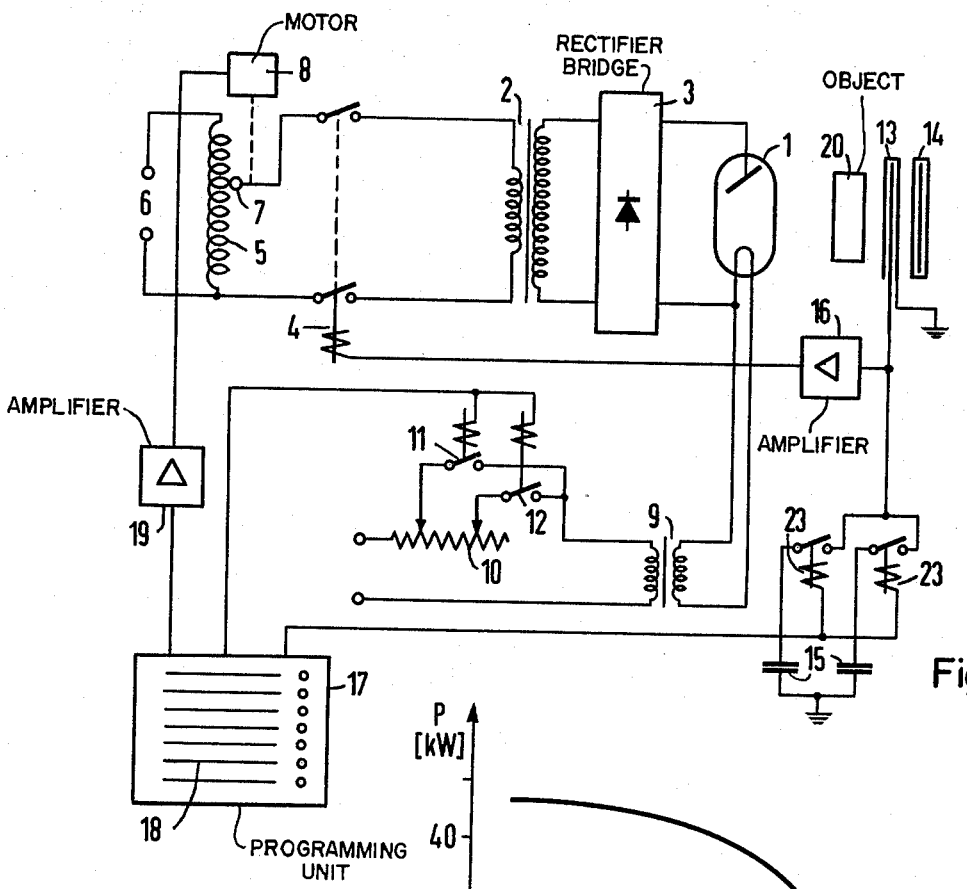
FIG. 1 illustrates a prior art X-ray diagnostic apparatus including an automatic exposure timer and automatic organ selecting device.

Illustrated in FIG. 1 of the drawing is a known X-ray diagnostic apparatus which includes an automatic exposure timer and an automatic organ selecting device. The X-ray diagnostic apparatus pursuant to FIG. 1 includes an X-ray tube 1 which obtains its electrode voltage from a high-voltage transformer through the intermediary of a rectifier bridge 3. The duration of an X-ray exposure is determined by a protective relay 4. The high-voltage transformer 2 is supplied with power from a power supply 6 across the variable transformer 5. The voltage of the X-ray tube 1 hereby is controlled through the aid of a pickup or tap-off 7 at the variable transformer 5. The tap-off 7 may be constructed as a carbon roll or rheostat and, with the aid of a motor, may be adjusted into a predetermined position along the winding of the variable transformer 5.

The emission current of the X-ray tube 1 during an exposure is dependent upon that particular voltage which supplies the primary winding of the heating filament transformer 9. The magnitude of this voltage depends upon how large is the portion of a resistor 10 which is located in series with the abovementioned transformer winding. The transformer winding is supplied from a power source which may be equal to the power source which supplies the regulating or variable transformer 5. The size of the active portion of the resistor 10 is determined with the aid of relay contacts 11, 12.

The automatic exposure timer contains an ionization chamber 13 which measures the X-ray dosage on the film 14 during the exposure of an object. The ionization current of the ionization chamber 13 charges one of two condensers 15, inasmuch as there is always closed one of the contacts of the relays 23. When a predetermined film dosage has been reached, then the voltage at the condenser 15 has risen to such a value, that an amplifier 16 will deactivate the protective relay 4, and interrupt the exposure.

The automatic exposure device may be programmed pursuant to the organs of a patient. This signifies that, dependent upon the body organ which is to be X-rayed or the type of examination, there are actuated operating push-buttons or a selector. The foregoing may be carried out with the aid of a programming arrangement 17, in which each operating push-button has associated therewith in areas or window 18 the name of an organ of the patient, or the designation of a particular type of examination. The programming arrangement 17 is associated with a program storage which, dependent upon the settings of the operating push-buttons, will so influence automatically predetermined exposure parameters, that the corresponding body organ is X-rayed to an optimum extent. The program storage may be constituted of a series or banks of resistors which provide analogous voltages in dependence upon a depressed operating push-button. The program storage, for example, through the intermediary of a servo-amplifier 19 may adjust the X-ray tube voltage by exerting an influence over the motor 8. The storage, in known arrangements, additionally sets a programmed X-ray tube current, which remains constant during the exposure, through influencing one of the relays 11, 12. The program storage may further, dependent upon the body organ, adjust for a desired picture darkening through influencing one of the relays which activate the condensers 15.

Figure 8:
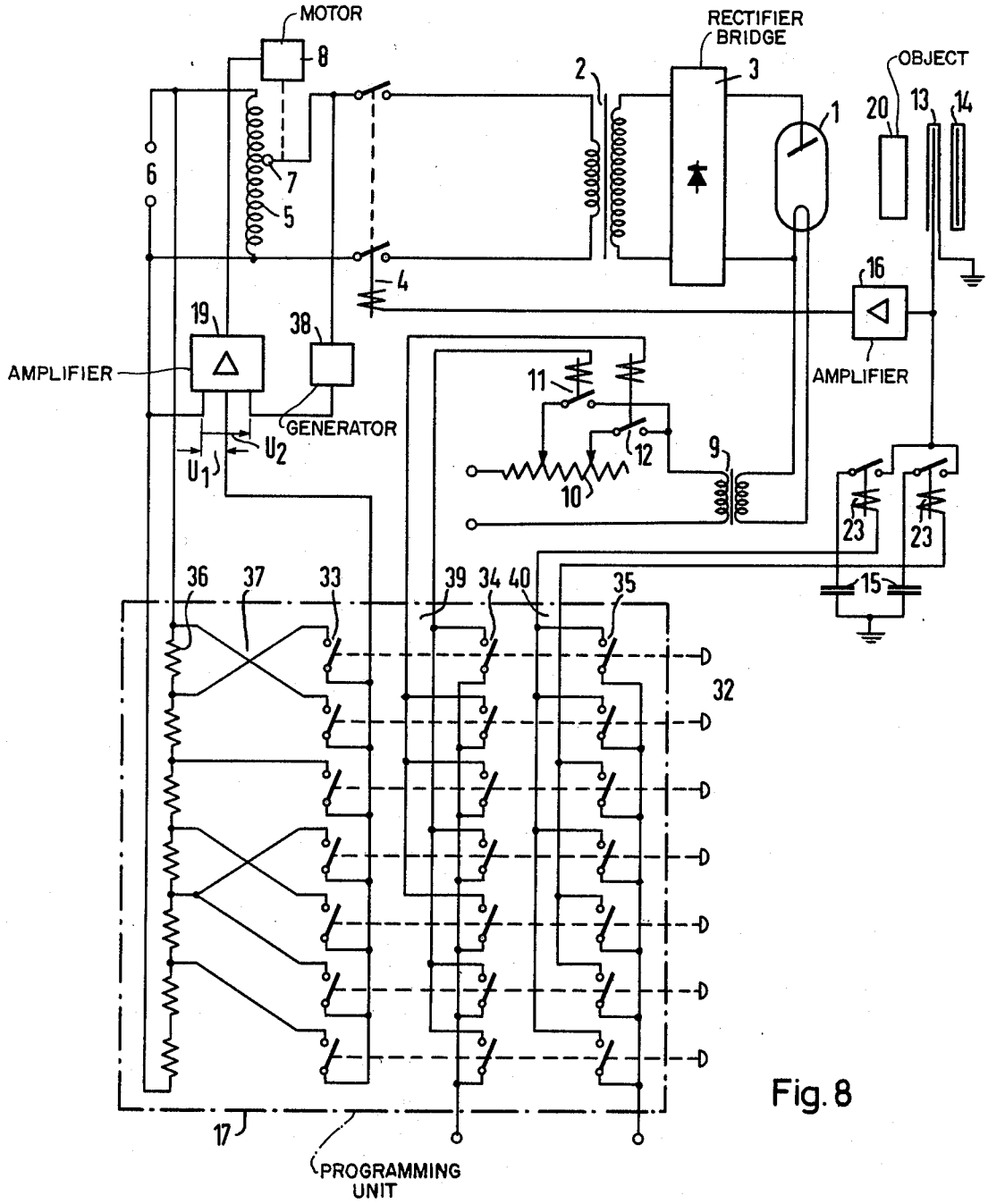
FIG. 8 shows the construction of the program storage for the present apparatus.

The construction of the program storage is more closely described in FIG. 8 of the drawings.

The operating push-buttons 32 are mechanically interconnected with contacts for the kV-setting 33, mA-setting 34 and picture darkening setting 35. A resistance series 36 has the supplying voltage at the contacts 6 transmitted thereto. The kV-programing of the program storage is carried out in the cross-rail distributor 37 prior to the initiation of operating of the X-ray apparatus. Upon depressing one of the push-buttons 32, the reference voltage $U_1$ for kV is transmitted to the servo-amplifier 19. This voltage is compared with the actual voltage $U_2$. The actual voltage consists of the voltage at the variable transformer 5 which is set by the rheostat 7, which is proportional to the no-lead X-ray tube voltage corrected for the voltage drop-off in the supply circuit for the X-ray tube during the exposure. These corrective voltage emanates from the circuit 38. The circuit 38 is an operational generator which delivers an output signal which depends upon the input signal corresponding to the desired function, for example, an amplifier having suitable characteristics.

The mA-programming is carried out by means of the cross bar distribution panel 39, and the picture darkening programming by means of the cross bar distribution panel 40.

Known automatic exposure timers of this type also automatically select one of a plurality of X-ray tubes and one of a plurality of examination apparatus through intermediary of the above-mentioned programming storage. However, difficulties are encountered in the known systems in view of the settings of adjustments of the parameters "X-ray tube voltage" and "X-ray tube current" when, for a predetermined body organ, there must be obtained the shortest possible exposure time for thin as well as also for heavy objects 20, while giving consideration to the load capacity of the X-ray tube 1.

Figure 2:
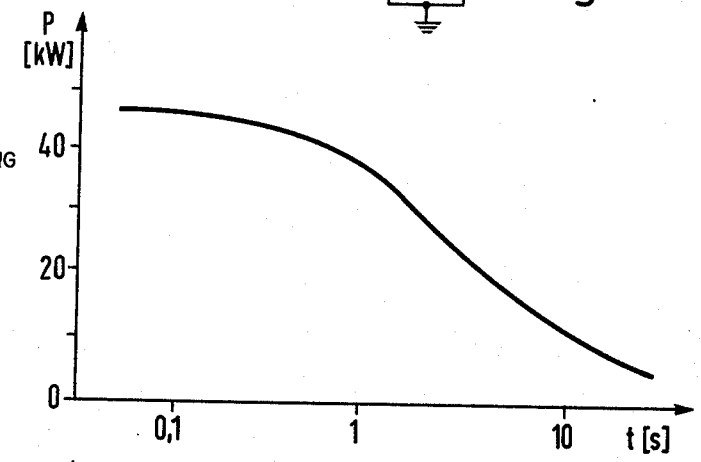
FIG. 2 is a graph illustrating the plot of maximum permissible X-ray tube power output as a function of exposure time.

Illustrated in FIG. 2 of the drawings, as an example, is the plot of the maximum permissible X-ray tube power output P in kW as a function of the exposure time T, in seconds. From this curve there may be ascertained that the power output must reduce with time so that the X-ray tube 1 will not be overloaded. In order to attain the least possible unclearness or blurring of the picture, it is desirable that the exposure be completed during the shortest possible time. So as to be able to achieve this for thin as well as for heavy objects, giving consideration to the curve pursuant to FIG. 2, it is known to associate a load regulating arrangement with the X-ray apparatus for "falling load" which fulfills the following condition during the exposure through a variation of the emission current of the X-ray tube 1:

$$U \cdot I = P(t),$$

wherein U = the X-ray tube voltage, I = the emission current of the X-ray tube, and P (t) = the maximum permissible X-ray tube output as a function of time pursuant to FIG. 2. The requirement pursuant to the equation is fulfilled by means of the load regulating arrangement, irrespective as to whether the exposure time is known or is not known prior to the exposure. The exposure time is not known prior to the exposure with the use of automatic exposure timers.

Figure 7:
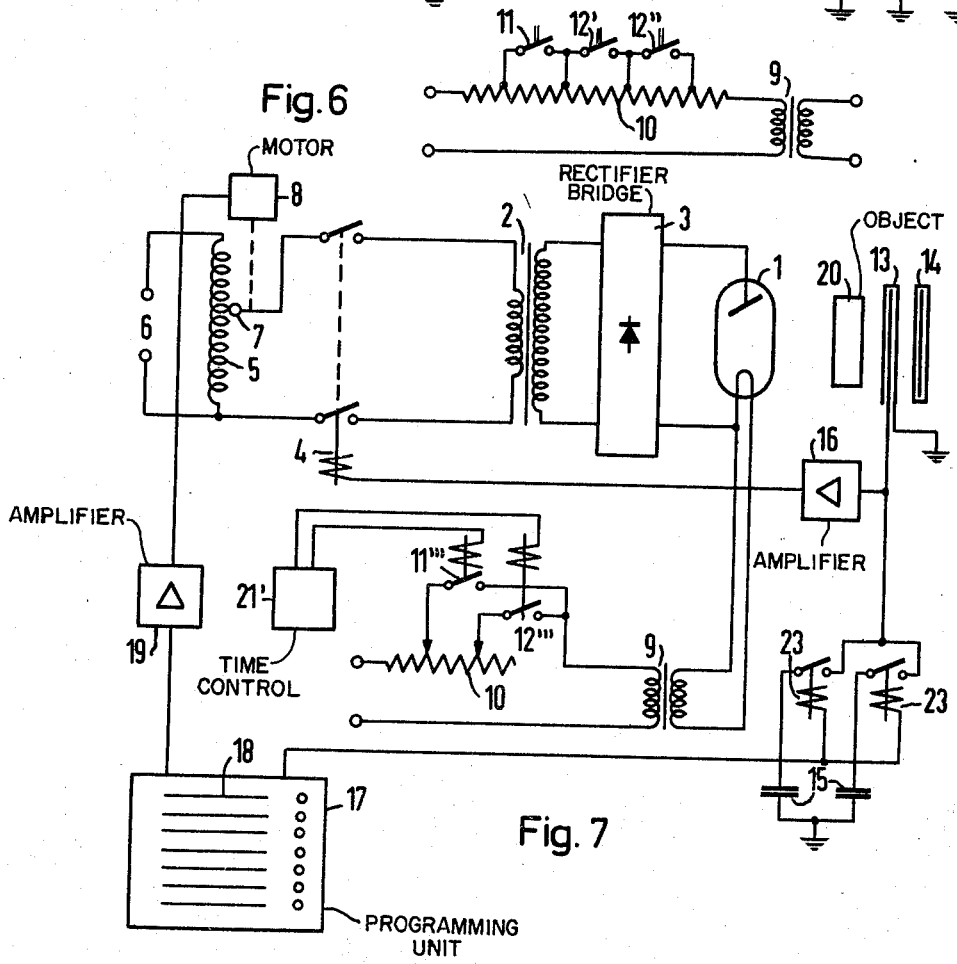
FIG. 7 shows an arrangement for reducing the emission current of the X-ray tube as a function of time.

The arrangement for reduction of the emission current of the X-ray tube with time may be constructed in accordance with FIG. 7. This arrangement is known with or without programming arrangement 17. The reduction of the emission current is achieved in that, at predetermined time points after the initiation of the exposure, relays 11''' and 12''' are open and additional amounts of resistance 10 is connected in. These relays are controlled by a time control circuit 21'. A technical problem encountered in the reduction of the emission current during the exposure previously has been the increase in the X-ray tube voltage due to the voltage drop off in the series impedance of the high-voltage generator. This voltage drop off may be 10 kV/100 mA, meaning, that when the X-ray tube current is changed during the exposure from 500 to 100 mA, then the X-ray tube voltage, for example, changes from 80 to 120 kV.

Figure 3:
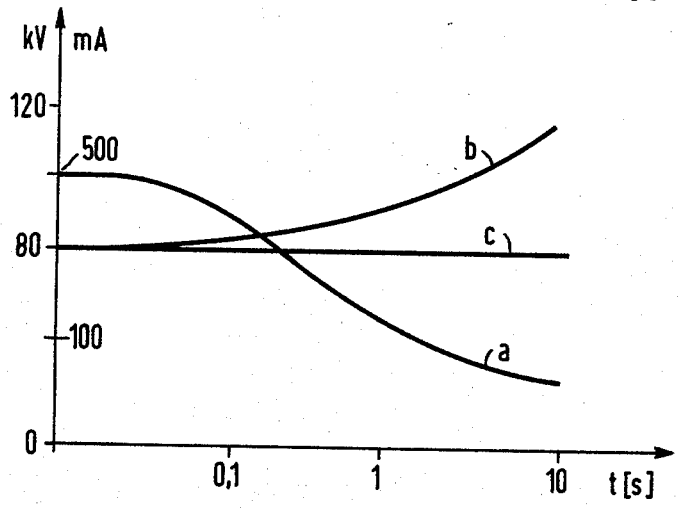
FIG. 3 is a graphical representation of emission current and X-ray tube voltage as a function of exposure time.

In FIG. 3 of the drawings, the curve *a* shows the falling emission current, and the curve *b* the increasing X-ray tube voltage. In order to prevent the voltage rise according to curve *b*, it is known that, during the exposure, resistances may be short-circuited by means of contacts which are connected in series with the high-voltage generator. A plurality of such contacts must be utilized so as to provide the best possible correlation. Resistances are utilized which are dimensioned for currents of up to a magnitude of 100 A. Another possibility, which is provided for maintaining the X-ray tube voltage constant, consists in the utilization of a voltage divider which subdivides the high-voltage. This voltage is then compared with a reference value. The differential voltage influences an amplifier, the latter of which so actuates the motor 8 as to change the position of the rheostat whereby the X-ray tube voltage will remain constant pursuant to curve *c* in FIG. 3 of the drawings.

In this relatively complicated and expensive X-ray apparatus, in which the shortest possible exposure time is attainable at a constant X-ray tube voltage, means are provided which, in a programmed automatic exposure timer, will undertake programming changes for objects which are thinner or heavier than normal so that the objects may be selectively exposed, dependent upon their thickness, at either a lower or, respectively, higher X-ray tube voltage. The purpose of the application of the lower X-ray tube voltage for a thin object, amongst others, is to reduce the dosage output so that the exposure period does not become too short. For an excessively short exposure period, the protective relay 4 cannot interrupt the exposure at the correct time due to its inherent inertia, so that there is obtained an overexposure of the picture. The purpose in the application of a higher X-ray tube voltage for a heavier object, in comparison with the normal case, is that there is obtained a shorter exposure period. The above-mentioned arrangement with "falling load" does not permit obtaining for heavy objects the best relationship between a low X-ray tube voltage which will deliver the best image contrast, and a short exposure time which will provide for the least picture distortion or blurring.

Figure 4:
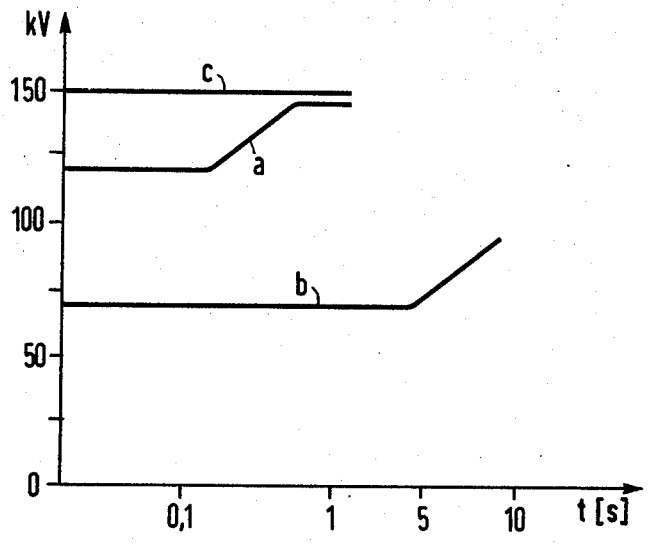
FIG. 4 illustrates a modified power output time diagram graph pursuant to the present invention.

Thus, for example, during the course of stomach examinations it is desirable that, dependent upon the movements of the object and for a heavy object, the emission current is reduced after approximately 0.1 seconds, so as to maintain for such objects a correspondingly measured short exposure period pursuant to curve *a*, FIG. 4.

During examinations of the spine it is important that, also for a heavy object, there is maintained a relatively low X-ray tube voltage. In many instances a long exposure time is desired during such examinations so that, due to the movement of the soft body portions, there is obtained a sharper picture of the spine. In this case, the reduction of the emission current is carried out after only approximately 4 seconds, so that the exposure may be interrupted with assurance within a correspondingly measured period also for heavy objects (FIG. 4, curve *b*).

At lung exposures, in which the programmed X-ray tube voltage lies at or proximate to the maximum permissible voltage of the X-ray tube, which is frequently 150 kV, due to technical reasons the X-ray tube voltage cannot be increased for a heavy object. In this instance, the emission current is maintained constant during the exposure, pursuant to FIG. 4, curve *c*.

In the inventive X-ray diagnostic apparatus it is possible to so control the emission current that it will not drop below the load capacity limit of the X-ray tube at significant increases in the X-ray tube voltage. The control may be carried out through resistors which are automatically connected in series with the high-voltage generator in dependence upon the organ programming. Through varying the falling-off rate of the emission current and the magnitude of the resistances in dependence upon a predetermined body organ, the image character may be optimized in conformance with the desire of the radiologist.

Figure 5:
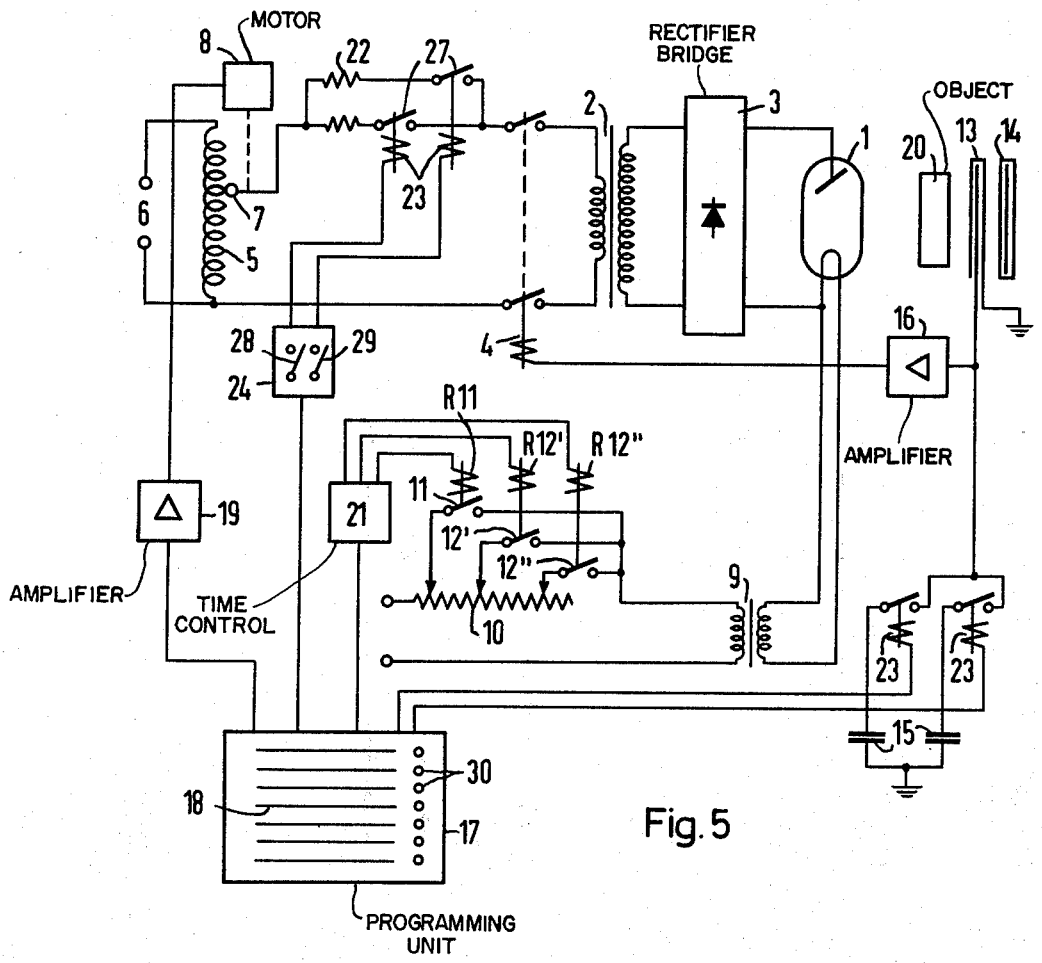
FIGS. 5 and 6 illustrate an X-ray diagnostic apparatus according to the invention.

An exemplary embodiment of the invention is illustrated in FIG. 5, and is described in greater detail hereinbelow. The elements 1 through 20 are the same as those in FIG. 1. The emission current of the X-ray tube drops at various timepoints during an exposure, inasmuch as there is provided a time control circuit 21 which influences the time cycle of the emission current. The programming arrangement has means associated therewith which, for a selected body organ or a selected type of examination, can influence the time control circuit 21. The reduction of the X-ray tube current may be carried out in that the time control circuit causes the switching in of one or more relay contacts 11, 12′, 12″ of the emission current circuit through associated relays R 11, R 12′, and R 12″.

A switching element 24 is provided, which is controlled by the programming arrangement 17, which controls two relays 23 which, by means of their contacts 27, each respectively facilitate the switching in of one of the resistances 22 ahead of the primary winding of the high-voltage transformer 2. In this manner it becomes possible to so vary the series impedance of the high-voltage generator prior to the exposure in dependence upon a predetermined body organ or a predetermined type of examination, so that the X-ray tube voltage automatically increases in conformance with a programmed sequence when the emission current reduces. The switching element 24 contains hereby two contacts 28 and 29 which, in conformance with the presently depressed push-button 30 on the programming arrangement 17, are selectively closed.

Figure 6:
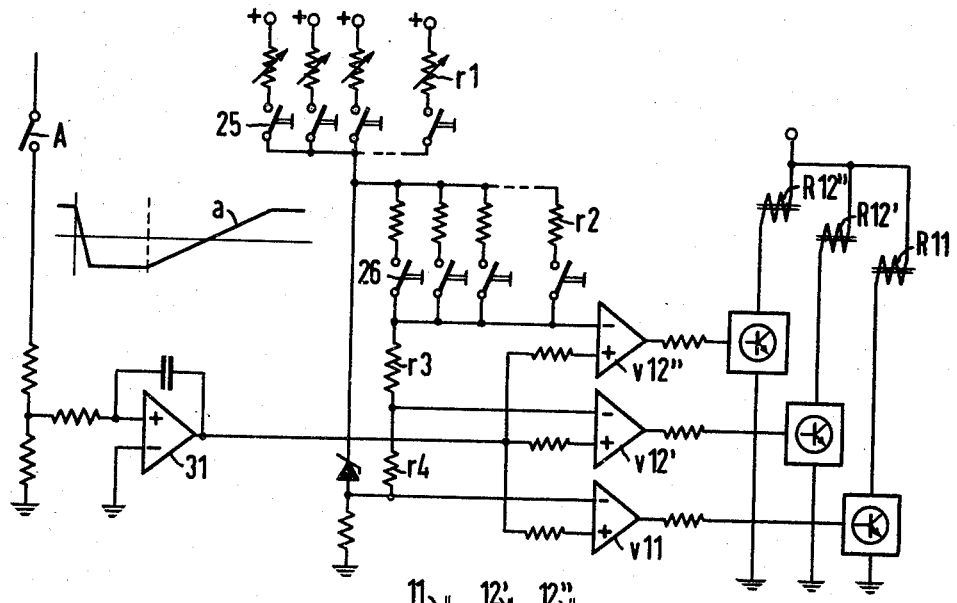

The time control circuit 21 may be constructed pursuant to FIG. 6. The contact A closes at the beginning of an exposure and controls an integrator 31 whose output voltage corresponds to curve *a*. The output voltage of the integrator controls three level-sensitive circuits *v* 11, *v* 12′ and *v* 12″ which close the contacts 11, 12′, 12″ when the voltage a increases. At the beginning of the exposure, the voltage a increases and first switches off the contact 11, then 12′, and then 12″. The timepoint at which the contact 11 is switched off is determined by the switching level of the circuit *v* 11. This level may be selected by means of the resistance r1 in dependence upon a selected exposure program. For this purpose serve contacts 25 which are associated with the operating organ-programmed push-buttons on the programming arrangement 17.

The time between the switching off of a contact 11 and the contact 12′ is determined from that particular resistance r2 which is switched in through intermediary of the contacts 26 dependent upon a predetermined exposure program. Thereafter, the relay contact 12″ is switched off. The time of the switching off of the contact 12″ is determined by the relationship between the resistances *r*3 and *r*4. The resistances *r*1 and *r*2 are located in the programming arrangement 17 and determined the switching over timepoints, alternatively dependent upon a depressed organ push-button of the arrangement 17. Through selection of one of the resistances *r*1, there may be varied the timepoint at which there commences the reduction in the current. The rate in the reduction of the current is determined by means of the resistance *r*2, *r*3 and *r*4.

Within the scope of the invention there may also be provided means which cause a signal to be generated when the X-ray tube voltage increases for a heavy object. Furthermore, there may also be provided an indicating arrangement which indicates the X-ray tube voltage representative for the picture contrast after an exposure when the X-ray tube voltage increases for a heavy object.

While there has been shown what is considered to be the preferred embodiment of the invention, it will be obvious that modifications may be made which come within the scope of the disclosure of the specification.

What is claimed is:

1. In an X-ray diagnostic apparatus, and X-ray tube for projecting X-rays onto a film; an automatic exposure timer for measuring the X-ray dosage received by said film from said X-ray tube and to automatically interrupt the exposure upon said dosage reaching a predetermined value; programming means for controllably varying, in dependence upon a body portion being X-rayed, the exposure parameters including X-ray tube voltage, the initial emission current and the darkening of the film; and a timing circuit for reducing the emission current of said X-ray tube during the exposure, the improvement comprising: means connected to said programming means for regulating said timing circuit pursuant to a preselected body organ or type of examination so as to reduce the emission current of said X-ray tube to a predetermined value during the exposure in dependence upon the organ being X-rayed and to thereby increase the X-ray tube voltage.

2. An apparatus as claimed in claim 1, said exposure device comprising a high-voltage generator, an impedance connected in series to said high-voltage generator, said regulating means including switching elements for varying said impedance prior to the exposure in dependence upon a predetermined body organ or type of examination so as to cause said X-ray tube voltage to automatically increase in conformance with a programmed sequence upon a reduction of said emission current.

* * * * *